US008893537B2

(12) United States Patent
Cox, III

(10) Patent No.: US 8,893,537 B2
(45) Date of Patent: Nov. 25, 2014

(54) METHODS AND APPARATUS TO DRIVE MATERIAL CONDITIONING MACHINES

(75) Inventor: Clarence B. Cox, III, McPherson, KS (US)

(73) Assignee: The Bradbury Company, Inc., Moundridge, KS (US)

( * ) Notice: Subject to any disclaimer, the term of this patent is extended or adjusted under 35 U.S.C. 154(b) by 979 days.

(21) Appl. No.: 12/260,780

(22) Filed: Oct. 29, 2008

(65) Prior Publication Data

US 2009/0113973 A1 May 7, 2009

Related U.S. Application Data

(60) Provisional application No. 60/986,187, filed on Nov. 7, 2007.

(51) Int. Cl.

| | |
|---|---|
| ***B21B 37/58*** | (2006.01) |
| ***B21B 31/07*** | (2006.01) |
| ***B21B 35/00*** | (2006.01) |
| ***B21D 1/02*** | (2006.01) |
| *B21B 15/00* | (2006.01) |
| *B21B 39/08* | (2006.01) |

(52) U.S. Cl.

CPC ..... *B21B 15/00* (2013.01); *B21B 2015/0071* (2013.01); *B21B 39/08* (2013.01); *B21D 1/02* (2013.01)

USPC ..... 72/10.2; 72/249

(58) Field of Classification Search

CPC ..... B21B 35/14; B21B 35/143; B21B 37/46; B21B 37/52; B21B 2015/0071

USPC ..... 72/10.2, 240, 249, 160–161, 163–165, 72/205; 700/152

See application file for complete search history.

(56) References Cited

U.S. PATENT DOCUMENTS

| | | | | |
|---|---|---|---|---|
| 1,946,240 A | | 2/1934 | Rohn | |
| 3,355,918 A | | 12/1967 | Wallace | |
| 3,867,826 A | * | 2/1975 | Noe | 72/205 |
| 4,126,028 A | | 11/1978 | Chapront | |

(Continued)

FOREIGN PATENT DOCUMENTS

| | | |
|---|---|---|
| CN | 103391823 | 11/2013 |
| EP | 0142577 | 5/1985 |

(Continued)

OTHER PUBLICATIONS

European Patent Office, "European Search Report," issued in connection with counterpart European patent application Serial No. 08019394.9, mailed Mar. 26, 2009, 11 pages.

(Continued)

*Primary Examiner* — Shelley Self
*Assistant Examiner* — Mohammad I Yusuf
(74) *Attorney, Agent, or Firm* — Hanley, Flight & Zimmerman, LLC

(57) ABSTRACT

Apparatus and methods to drive material conditioning machines are described. An example apparatus includes a first plurality of work rolls to process a strip material and a second plurality of work rolls to process the strip material. The example apparatus also includes a motor to drive the second plurality of work rolls. The motor is to apply a first rolling torque to the second plurality of work rolls that is different than a second rolling torque applied to the first plurality of work rolls.

26 Claims, 12 Drawing Sheets

(56) References Cited

U.S. PATENT DOCUMENTS

| | | | | |
|---|---|---|---|---|
| 4,244,204 | A | 1/1981 | Vydrin et al. | |
| 4,287,738 | A | 9/1981 | Hojas et al. | |
| 4,354,372 | A | 10/1982 | Inoue et al. | |
| 4,485,497 | A | 12/1984 | Miura | |
| 4,599,883 | A | 7/1986 | Ginzburg et al. | |
| 4,635,458 | A | 1/1987 | Bradlee | |
| 4,651,549 | A | 3/1987 | Masui | |
| 4,730,472 | A | 3/1988 | Ellis | |
| 4,881,392 | A | 11/1989 | Thompson et al. | |
| 5,632,177 | A | 5/1997 | Narita et al. | |
| 5,713,256 | A | 2/1998 | Keeny | |
| 5,874,813 | A | 2/1999 | Bode et al. | |
| 6,205,829 | B1 * | 3/2001 | Schwedt | 72/10.2 |
| 6,769,279 | B1 | 8/2004 | Bergman et al. | |
| 7,086,260 | B2 | 8/2006 | Abi-Karam | |
| 7,294,991 | B2 | 11/2007 | Kimura et al. | |
| 7,383,711 | B2 | 6/2008 | McKenna | |
| 7,812,558 | B2 | 10/2010 | Mori et al. | |
| 2006/0277959 | A1 | 12/2006 | McKenna | |
| 2010/0058823 | A1 * | 3/2010 | Polatidis et al. | 72/10.2 |
| 2012/0047977 | A1 | 3/2012 | Smith et al. | |

FOREIGN PATENT DOCUMENTS

| | | | | |
|---|---|---|---|---|
| EP | 2058059 | | 5/2009 | |
| FR | WO 2007/060310 | * | 5/2007 | B21D 1/02 |
| JP | 58038610 | | 3/1983 | |
| JP | 58084614 | | 5/1983 | |
| JP | 60099430 | | 6/1985 | |
| JP | 2003251408 | | 9/2003 | |
| JP | 2003675393 | | 9/2003 | |
| WO | 2012048153 | | 4/2012 | |

OTHER PUBLICATIONS

State Intellectual Property Office of P.R. China, "First Office Action," with English translation, issued in connection with Chinese application serial No. 200810173199.2, issued Dec. 31, 2011, 14 pages.

European Patent Office, "Office Communication," issued in connection with application serial No. 08019394.9, issued May 14, 2012, 4 pages.

International Searching Authority, "International Search Report," issued in connection with application serial No. PCT/US2011/055160, mailed Jan. 20, 2012, 4 pages.

International Searching Authority, "Written Opinion of the International Searching Authority," issued in connection with application serial No. PCT/US2011/055160, mailed Jan. 20, 2012, 6 pages.

United States Patent and Trademark Office, "Final Office Action," issued in connection with U.S. Appl. No. 13/267,760, mailed Jul. 31, 2012, 12 pages.

United States Patent and Trademark Office, "Non-Final Office Action", issued in connection with U.S. Appl. No. 13/267,760, mailed Feb. 29, 2012, 17 pages.

Intellectual Property Office of P.R. China, "Second Office Action," issued in connection with Chinese application serial No. 200810173199.2, issued Oct. 9, 2012, 7 pages.

The State Intellectual Property Office of China, "Third Notification of Office Action," issued in connection with Chinese Patent Application No. 200810173199.2, May 17, 2013, 13 pages.

The State Intellectual Property Office of China, "Fourth Notification of Office Action," issued in connection with Chinese Patent Application No. 200810173199.2, Oct. 8, 2013, 18 pages.

The State Intellectual Property Office of China, "Decision for Rejection," issued in connection with Chinese Patent Application No. 200810173199.2, Jan. 27, 2014, 20 pages.

United States Patent and Trademark Office, "Office Action," issued in connection with U.S. Appl. No. 13/267,760, mailed on Apr. 24, 2014, 25 pages.

International Searching Authority, "International Preliminary Report on Patentability," issued in connection with International Application Serial No. PCT/US2011/055160, mailed on Apr. 18, 2013, 7 pages.

European Patent Office, "Communication pursuant to Article 94(3) EPC," issued in connection with European Patent Application No. 11 770 655.6, issued on Mar. 3, 2014, 5 pages.

Canadian Intellectual Property Office, "Office Action," issued in connection with Canadian Patent Application No. 2,814,077, issued on Jun. 12, 2014, 3 pages.

United States Patent and Trademark Office, "Final Office Action," issued in connection with U.S. Appl. No. 13/267,760, mailed on Oct. 7, 2014, 19 pages.

* cited by examiner

METHODS AND APPARATUS TO DRIVE MATERIAL CONDITIONING MACHINES

CROSS REFERENCE TO RELATED APPLICATION

This patent claims the benefit of U.S. Provisional Patent Application, Ser. No. 60/986,187 entitled "Methods and Apparatus to Drive Material Conditioning Machines," filed Nov. 7, 2007, and is incorporated herein by reference in its entirety.

FIELD OF THE DISCLOSURE

The present disclosure relates generally to material conditioning machines, and more particularly, to apparatus and methods to drive material conditioning machines.

BACKGROUND

Material conditioners have long been used in processing strip material used in connection with mass production or manufacturing systems. In a manufacturing system, a strip material (e.g., a metal) is typically removed from a coiled quantity of the strip material. However, a strip material may have certain undesirable characteristics such as, for example, coil set, crossbow, edgewave and centerbuckle, etc. due to shape defects and internal residual stresses resulting from the manufacturing process of the strip material and/or storing the strip material in a coiled configuration. A strip material is manufactured using rolling mills that flatten material slabs into the strip material by passing it through a series of rollers. Once flattened, the strip material is typically rolled into a coil for easier handling. Shape defects and internal residual stresses are developed within the strip material as it passes through the rolling mill as it is subjected to non-uniform forces applied across its width.

Laser and/or plasma cutters are often used to cut strip material and perform best when cutting high-quality, substantially flat materials. Internal residual stresses can cause twist or bow in a strip material that can be particularly damaging to laser cutters and/or plasma cutters used to cut the strip material. For example, when the cutting head of a laser cutter and/or a plasma cutter is brought in close proximity to the surface of the strip material, any non-flat portions of the strip material can potentially strike and damage the cutting head. Also, when portions of the strip material are cut off during the laser and/or plasma cutting process, internal residual stresses can cause the strip material to deform and cause damage to the cutting head of the laser cutter and/or the plasma cutter. In addition, the quality of the cut will vary as the flatness of the material varies.

For optimum part production, a strip material should have uniform flatness along its cross-section and longitudinal length, and be free from any shape defects and any internal residual stresses. To prepare a strip material for use in production when the strip material is removed from a coil, the strip may be conditioned prior to subsequent processing (e.g., stamping, punching, plasma cutting, laser cutting, etc.). Levelers are well-known machines that can substantially flatten a strip material (e.g., eliminate shape defects and release the internal residual stresses) as the strip material is pulled from the coil roll. Levelers typically bend a strip material back and forth through a series of work rolls to reduce internal stresses by permanently changing the memory of the strip material.

Typically, the work rolls of a leveler are driven using a constant speed and rolling torque as a strip material is processed through the leveler. However, applying a constant torque and constant speed to the work rolls may only be effective to remove residual stresses near the surface of the strip material because only the surface of the material is stretched or elongated beyond the yield point of the strip material. This leaves unstretched portions in the thickness of the strip material resulting in relatively minor or negligible permanent change to internal stresses of the strip material.

DETAILED DESCRIPTION

In general, levelers are used to reduce residual stresses trapped in a strip material 100. The example methods and apparatus described herein can be used to implement a dual or split drive leveler that includes a dual or split drive system to drive its work rolls. In particular, a first motor is used to drive a first plurality of work rolls at an entry of the leveler and a second motor is used to drive a second plurality of work rolls at an exit of the leveler. The second motor applies a relatively greater rolling torque and/or speed to the second plurality of work rolls than the first motor applies to the first plurality of work rolls. Controlling the first set of work rolls and the second set of work rolls independent of each other in this manner enables relatively more reduction of residual stresses in the material exiting the leveler by causing more of the material to be stretched beyond a yield point of the strip material. In other example implementations, the dual or split drive leveler described herein can be implemented using one motor to provide a first rolling torque and/or speed to the first plurality of work rolls (i.e., entry work rolls) and a second rolling torque and/or speed to the second plurality of work rolls (i.e., exit work rolls) that is greater than the first rolling torque and/or speed. The motor can be configured to provide first and second rolling torques and/or first and second speeds to the entry and exit work rolls using, for example, transmissions, gear drive configurations, torque converters, clutches, belts, etc. In yet other example implementations, each work roll can be driven by a separate, respective motor via, for example, a shaft, an arbor, a spindle, etc., or any other suitable drive.

Figure 1A:
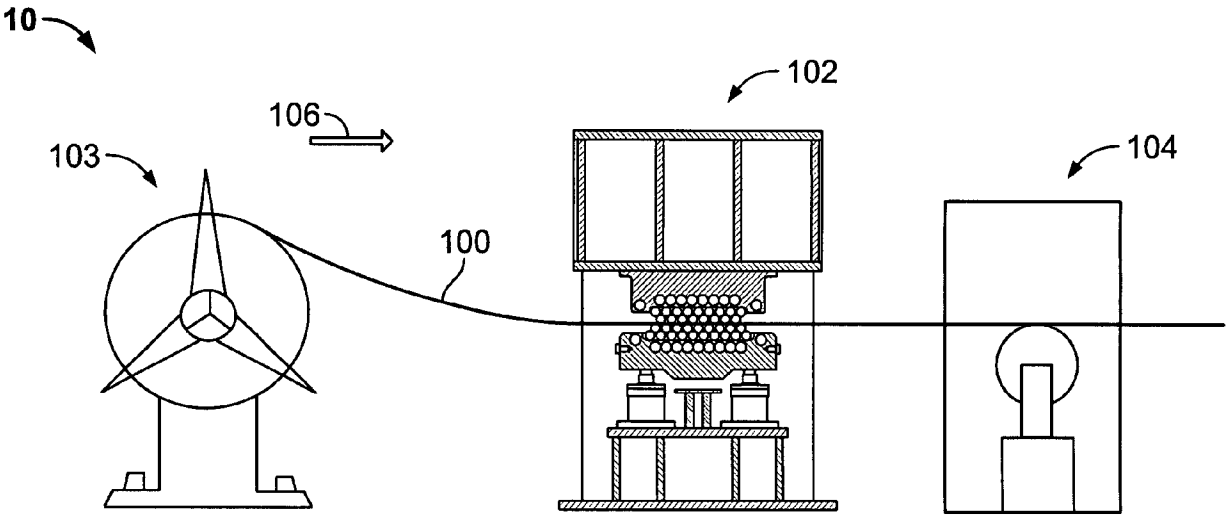
FIG. 1A is a side view of an example production system configured to process a moving strip material using an example dual or split drive leveler.
Figure 1C:
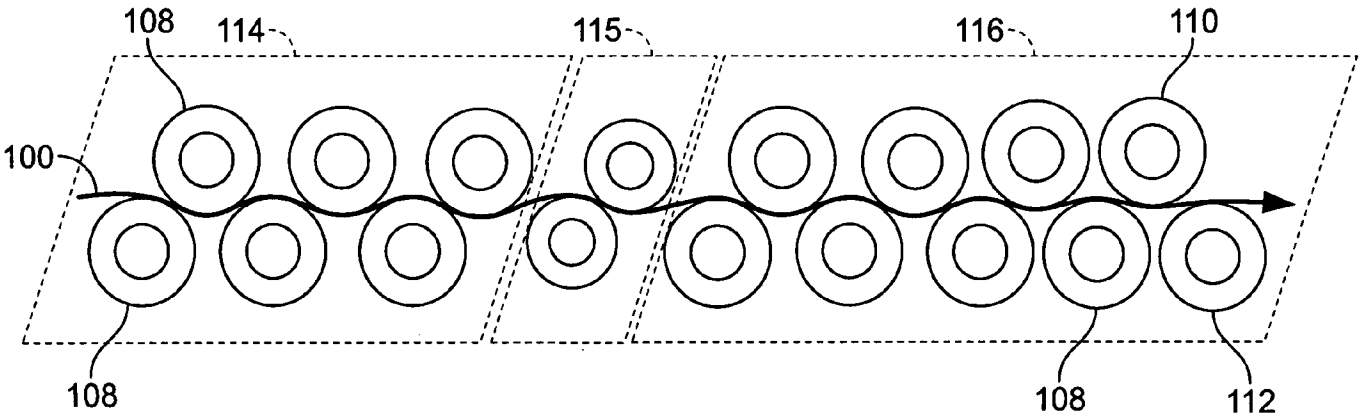
FIG. 1C illustrates an example configuration of work rolls of the example dual or split drive leveler of FIGS. 1A and 1B.
Figure 1B:
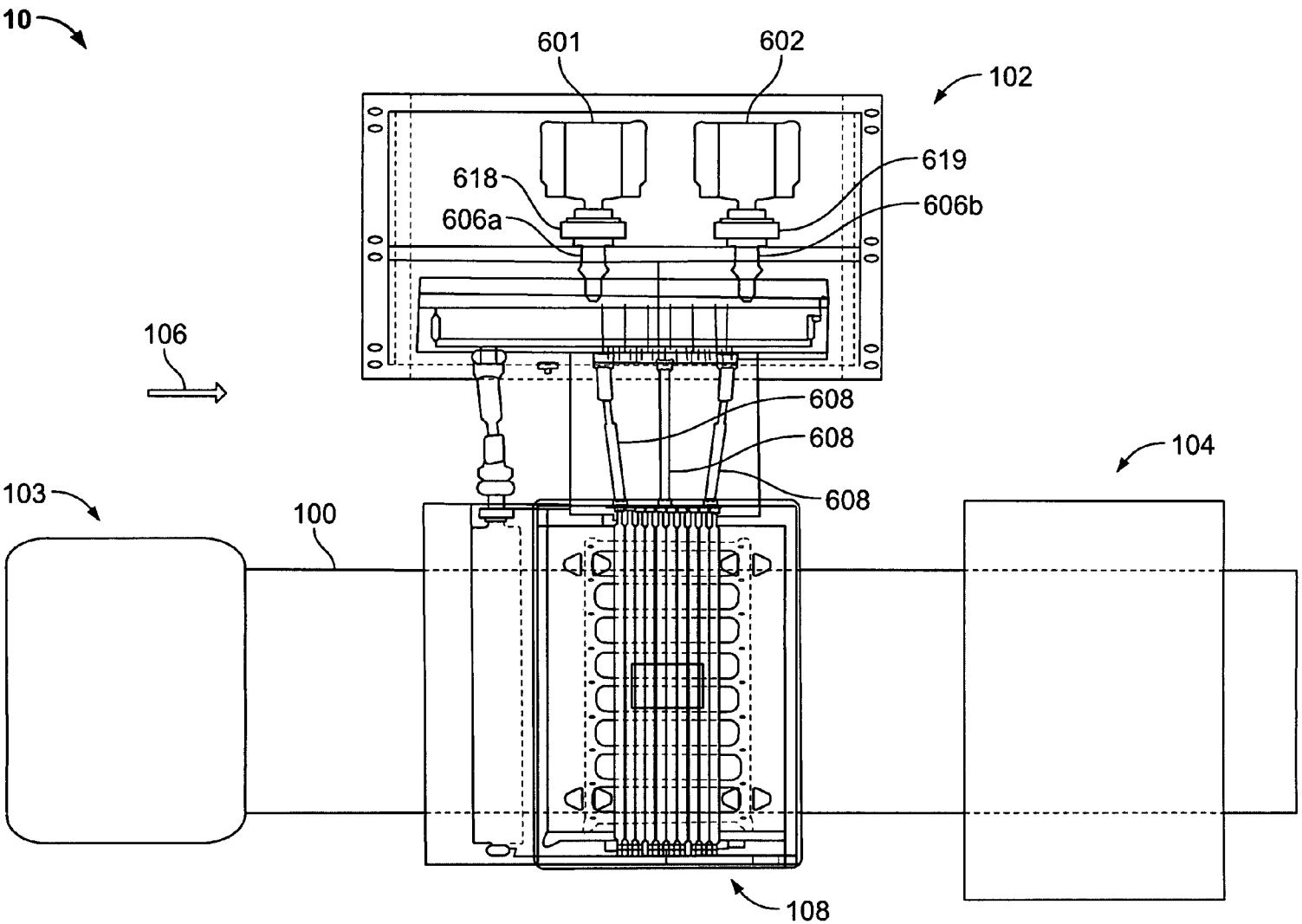
FIG. 1B is a plan view of the example production system of FIG. 1A.
Figure 2A:
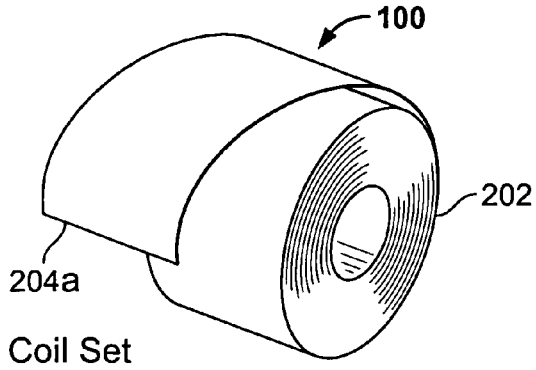
FIGS. 2A-2E illustrate example shape defects caused by non-uniform forces applied across the strip material when processed through a rolling mill and/or resulting from storage in a coiled configuration.
Figure 2B:
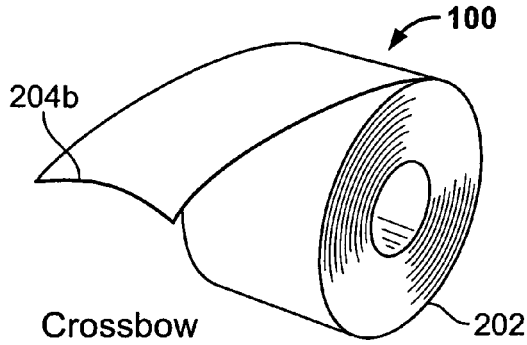
Figure 2C:
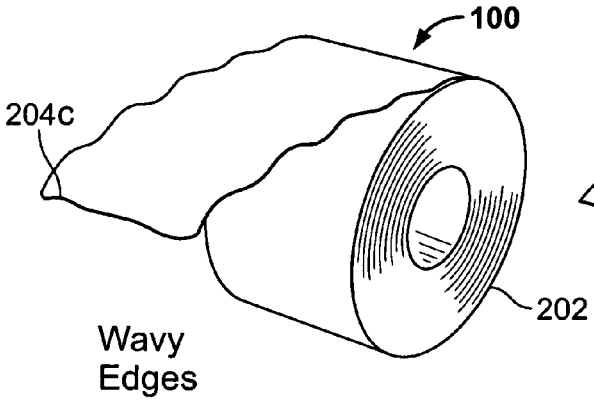
Figure 2D:
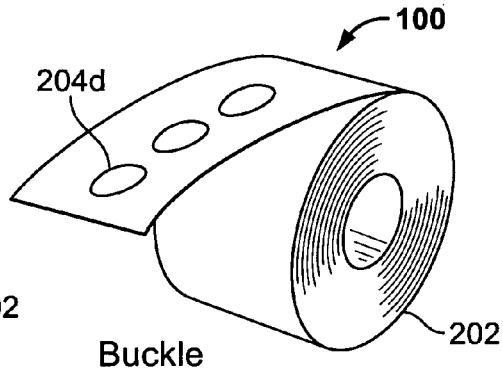
Figure 2E:
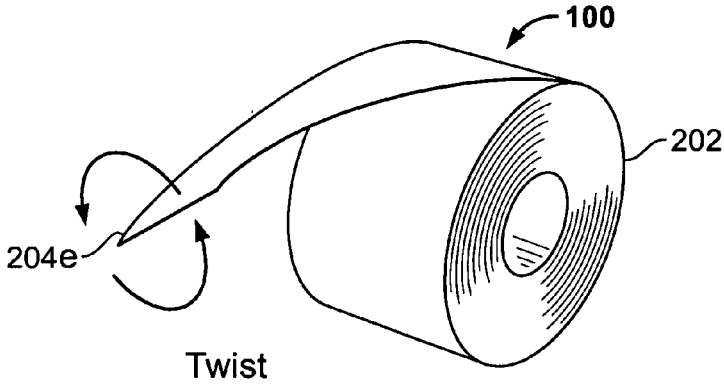

FIG. 1A is a side view and FIG. 1B is a plan view of an example production system 10 configured to process a moving strip material 100 using an example dual or split drive leveler system 102 (i.e., the split drive leveler 102). In some example implementations, the example production system 10 may be part of a continuously moving strip material manufacturing system, which may include a plurality of subsystems that modify, condition or alter the strip material 100 using processes that, for example, level, flatten, punch, shear, and/or fold the strip material 100. In alternative example implementations, the split drive leveler 102 may be implemented as a standalone system.

In the illustrated example, the example split drive leveler 102 may be placed between an uncoiler 103 and a subsequent operating unit 104. The strip material 100 travels from the uncoiler 103, through the leveler 102, and to the subsequent operating unit 104 in a direction generally indicated by arrow 106. The subsequent operating unit 104 may be a continuous material delivery system that transports the strip material 100 from the split drive leveler 102 to a subsequent operating process such as, for example, a punch press, a shear press, a roll former, etc. In other example implementations, sheets precut from, for example, the strip material 100 can be sheet-fed through the leveler 102.

FIG. 1C illustrates a plurality of work rolls 108 of the split drive leveler 102 arranged as a plurality of upper work rolls 110 and lower work rolls 112. The work rolls 108 can be implemented using steel or any other suitable material. The upper work rolls 110 are offset relative to the lower work rolls 112 so that the strip material 100 is fed through the upper and lower work rolls 110 and 112 in an alternating manner. In the illustrated example, the work rolls 110 and 112 are partitioned into a plurality of entry work rolls 114 and a plurality of exit work rolls 116. The entry work rolls 114 are driven independent of the exit work rolls 116 and the entry work rolls 114 can be controlled independent of the exit work rolls 116. In this manner, the exit work rolls 116 can apply relatively more rolling torque to the strip material 100 than the amount of rolling torque applied by the entry work rolls 114. Additionally or alternatively, the exit work rolls 116 can be operated at a relatively higher speed than the entry work rolls 114. In other example implementations, the example split drive leveler 102 can be provided with a plurality of idle work rolls 115 that can be positioned between and in line with the entry work rolls 114 and the exit work rolls 116. The idle work rolls 115 are typically non-driven but can be driven in some implementations.

In operation, the split drive leveler 102 receives the strip material 100 from the uncoiler 103 and/or precut sheets can be sheet-fed though the leveler 102. The entry work rolls 114 reshape the strip material 100 by reducing the internal stresses of the strip material 100. The exit work rolls 116 adjust any remaining internal stresses of the strip material 100 to impart a flat shape on the strip material 100 as it leaves the split drive leveler 102. The strip material 100 may be taken away or moved away in a continuous manner from the leveler 102 by the second operating unit 104.

FIGS. 2A-2E illustrate example shape defects caused by non-uniform forces applied across the strip material when processed through a rolling mill. The internal residual stresses and shape defects illustrated by way of example in FIGS. 2A-2E can be substantially reduced or eliminated using the example split drive leveler 102 of FIG. 1A. The strip material 100 may be a metallic substance such as, for example, steel or aluminum, or may be any other suitable material. In a coiled state, the strip material 100 is subject to variable and asymmetrical distribution of residual stresses along its width and length that cause shape defects in the strip material 100. As the strip material 100 is uncoiled from a coiled roll 202, it may assume one or more uncoiled conditions or states 204*a-e*. In particular, the strip material 100 may have one or more of coil set 204*a*, crossbow 204*b*, wavy edges 204*c*, buckle 204*d*, and/or twist 204*e*.

Leveling and/or flattening techniques are implemented based on the manners in which strip materials react to stresses imparted thereon (e.g., the amount of load or force applied to a strip material). For example, the extent to which the structure and characteristics of the strip material 100 change is, in part, dependent on the amount of load, force, or stress applied to the strip material 100.

Figure 3A:
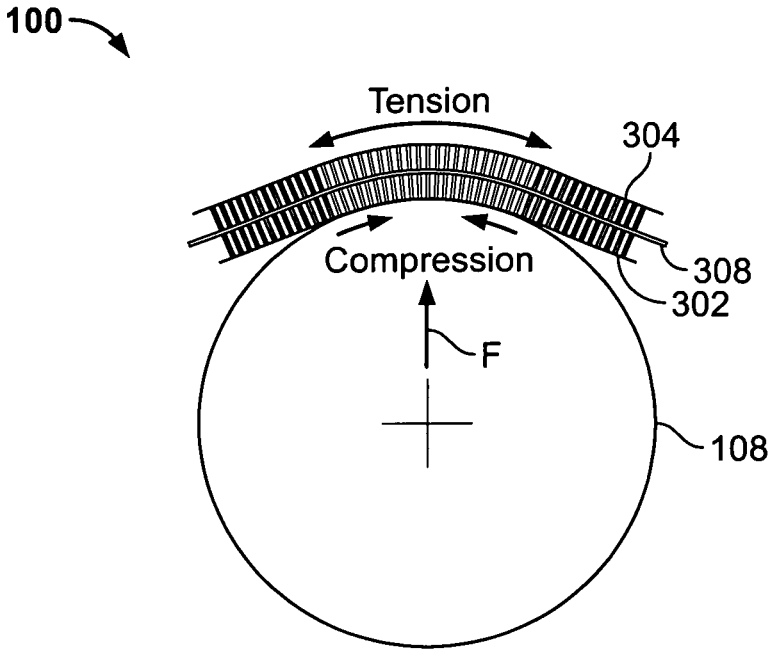
FIG. 3A illustrates example areas of compression and tension on a section of a strip material engaged by a work roll.

FIG. 3A illustrates example areas of compression and tension on a section of the strip material 100 passing over one of the work rolls 108 of FIG. 1B. The magnitude of the forces used to condition the strip material 100 depends on the type or amount of reaction the strip material 100 has to being wrapped or bent about a surface of the work roll 108. For purposes of discussion, the strip material 100 is described herein as if the strip material 100 were formed using planar layers. As shown in FIG. 3A, the work roll 108 is typically used to apply a load (i.e., a plunge force F) to the strip material 100. The plunge force F applied by the work roll 108 to the strip material 100 is created by increasing a plunge of the work roll 108 toward the strip material 100. The plunge force F causes a bottom surface 302 of the strip material 100 to be in compression and a top surface 304 of the strip material 100 to be in tension. A neutral axis 308 shown along the center of the strip material 100 is neither in compression nor tension. Deforming the strip material 100 in this manner causes the strip material 100 to bend or stretch.

Figure 3B:
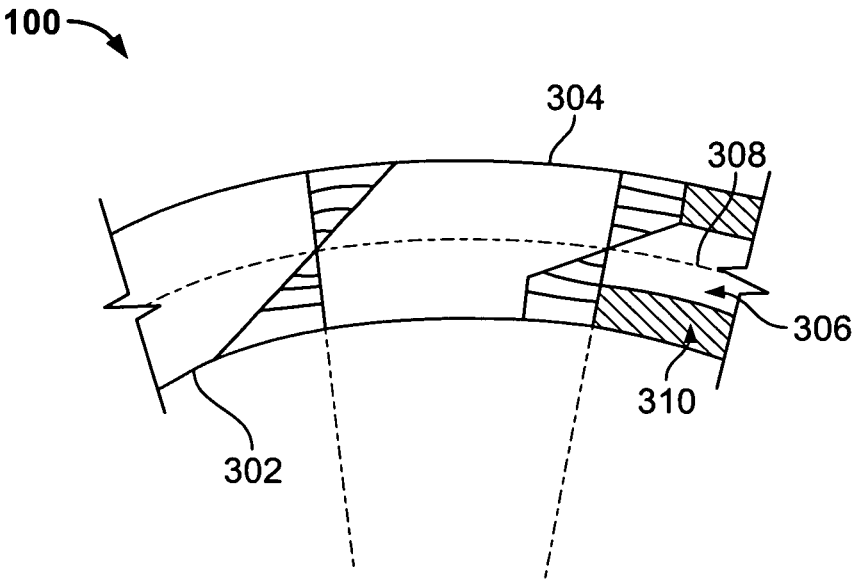
FIG. 3B illustrates the effect of plastic deformation of a strip material resulting from a plunge force applied by a work roll against the strip material.

FIG. 3B illustrates an elastic region 306 and a plastic region 310 in the strip material 100. Bending the strip material 100 using a relatively low plunge force F maintains the material in an elastic phase represented by the elastic region 306 about the neutral axis 308. In an elastic phase, residual stresses of a strip material remain unchanged. To substantially reduce or eliminate residual stresses, the strip material 100 must be stretched beyond the elastic phase to a plastic phase represented by the plastic region 310. That is, the strip material 100 must be stretched so that the plastic region 310 extends to the entire thickness of the strip material 100. Otherwise, when the plunge force F applied to a portion of the strip material 100 is removed without having stretched portions of it to the plastic phase, the residual stresses remain in those portions of the strip material 100 causing the material 100 to return to its shape prior to the force being applied. In such an instance, the strip material 100 has been flexed, but has not been bent.

The plunge force F applied to the strip material 100 can be increased to transition the material from the elastic phase to the plastic phase to substantially reduce or eliminate the residual stresses of the strip material 100 that cause undesired characteristics or deformations. Specifically, small increases in the force or load applied to the strip material 100 cause relatively large amounts of stretching (i.e., deformation) to occur in the plastic load region 310. The amount of force required to cause a metal to change from an elastic condition to a plastic condition is commonly known as yield strength. Yield strengths of metals having the same material formulation are typically the same, while metals with different formulations have different yield strengths. The amount of plunge force F needed to exceed the yield strength of a material can be determined based on the diameters of the work rolls 108, the horizontal separation between neighboring work rolls 108, a modulus of elasticity of the material, a yield strength of the material, and a thickness of the material.

Figure 4A:
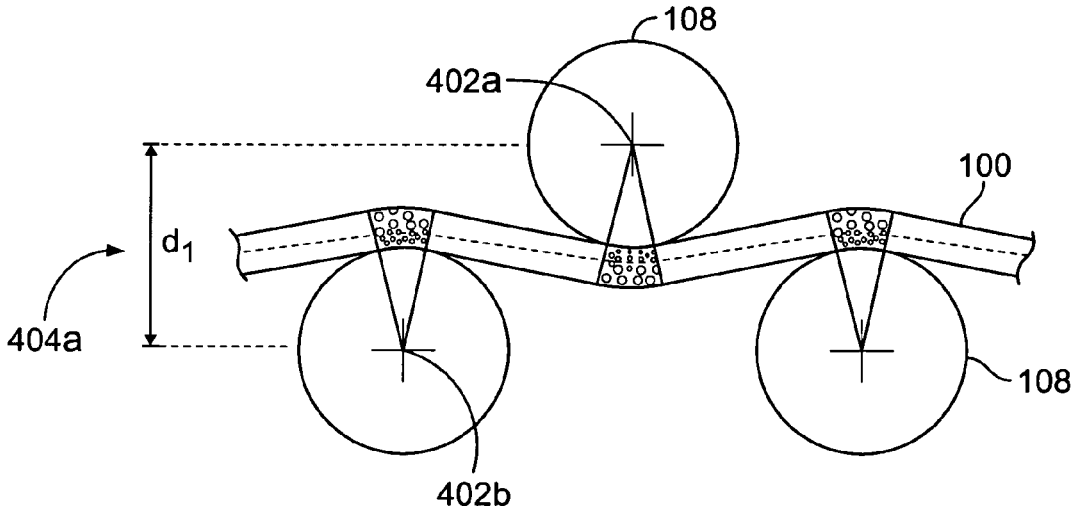
FIGS. 4A and 4B illustrate the manner in which decreasing the vertical center distance between work rolls increases a tensile stress imparted on a strip material when tension is applied.
Figure 4B:
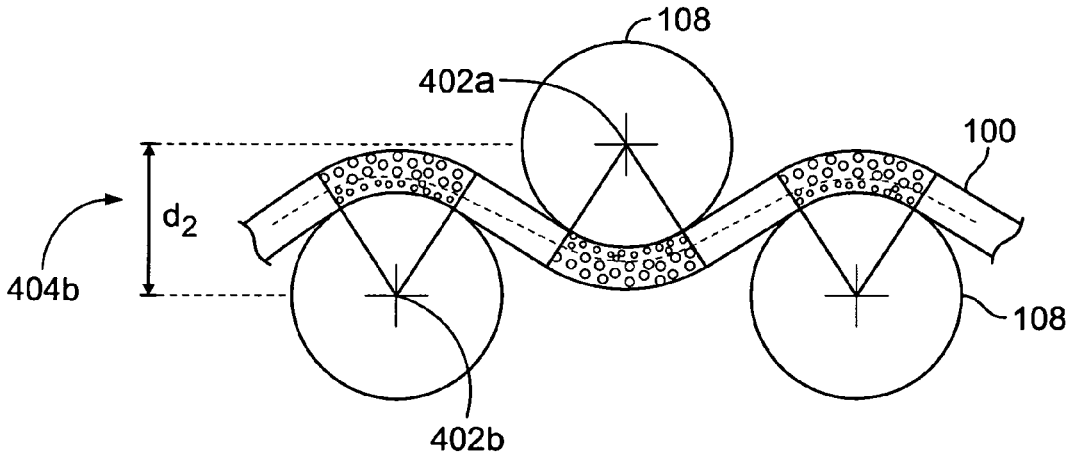

Turning to FIGS. 4A and 4B, a work roll plunge can be varied by changing a distance between center axes 402*a* and 402*b* of the work rolls 108. For example, a plunge distance ($d_1$) 404*a* (FIG. 4A) can be decreased to create a plunge distance ($d_2$) 404*b* (FIG. 4B) by decreasing the distance between the center axes 402*a* and 402*b* along respective vertical planes. Referring to FIG. 1A, in the illustrated example, the plunge of the entry work rolls 114 is set to deform the strip material 100 beyond its yield strength. In the illustrated example, the plunge of the entry work rolls 114 is relatively greater than the plunge of the exit work rolls 116. In some example implementations, the plunge of the exit work rolls 116 can be set so that they do not deform the strip material 100 by any substantial amount but instead adjust the shape of the strip material 100 to a flat shape (e.g., the plunge of the exit work rolls 116 is set so that a separation gap between opposing surfaces of the upper and lower work rolls 110 and 112 is substantially equal to the thickness of the strip material 100).

Applying a relatively greater plunge (i.e., a smaller distance between the work roll center axes 402*a* and 402*b*) at the entry work rolls 114 requires a relatively stronger plunge force to reduce a substantial amount of internal stresses (e.g., 70%, 80%, etc.) that are trapped in the strip material 100 by stretching and/or elongating the strip material 100. As work roll plunge decreases at, for example, the exit work rolls 116, the amount of plunge force required to linearly actuate the work rolls or hold the work rolls at a particular plunge also decreases. Thus, the amount of power used to generate a required plunge force at the entry work rolls 114 is relatively more than the amount of power required to plunge the exit work rolls 116 because the plunge of the entry work rolls 114 is relatively greater than that of the exit work rolls 116.

Figure 5:
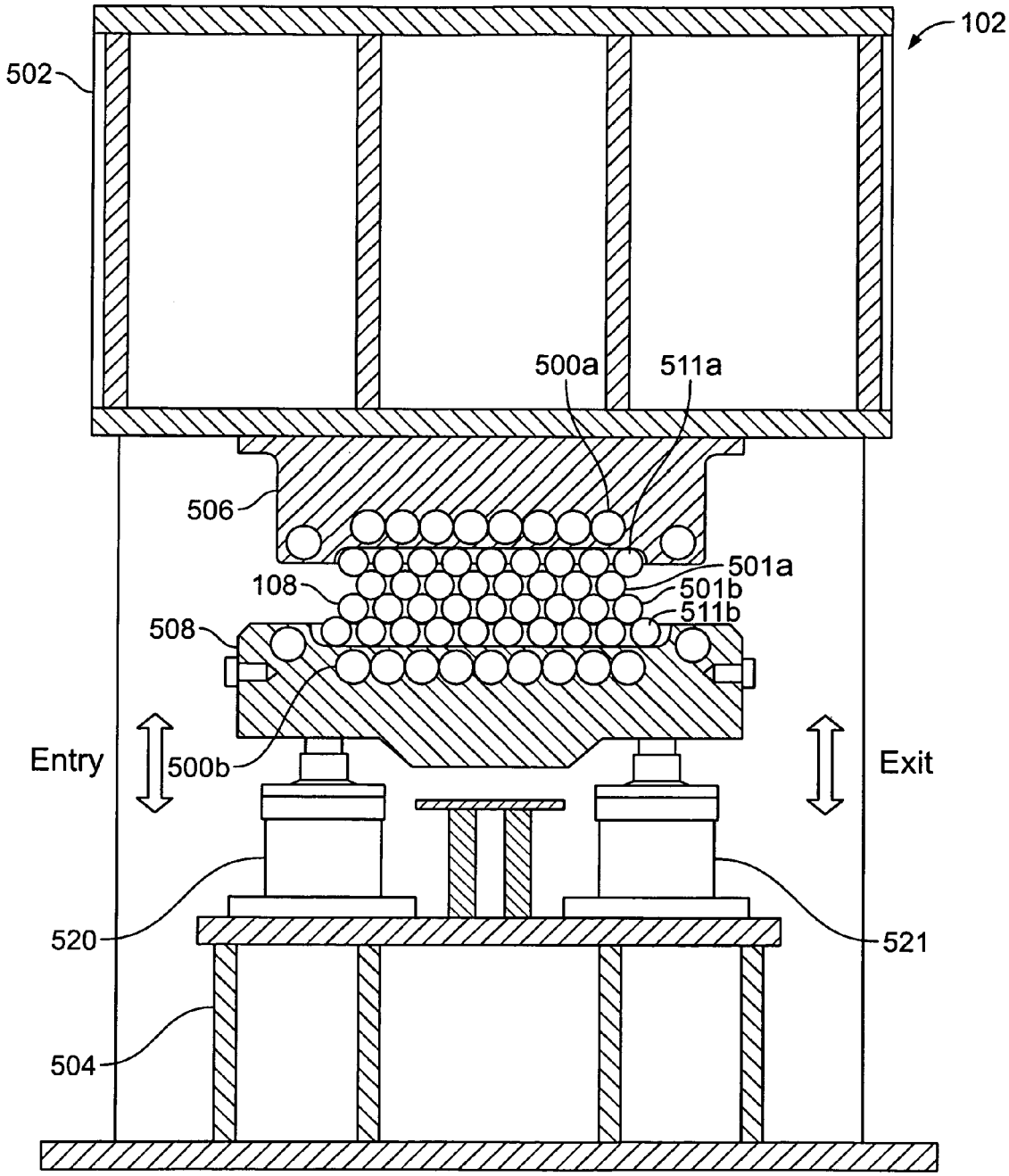
FIG. 5 is a side view illustration of the example dual or split drive leveler of FIGS. 1A and 1B.

FIG. 5 illustrates the example split drive leveler 102 of FIGS. 1A and 1B. The split drive leveler 102 has an upper frame 502 and a bottom frame 504. The upper frame 502 includes an upper backup 506 mounted thereon and the bottom frame 504 includes an adjustable backup 508 mounted thereon. As shown in FIG. 5, the upper backup 506 is non-adjustable and fixed to the frame 502. However, in other example implementations, the upper backup 506 may be adjustable.

The upper backup 506 includes a row of backup bearings 500*a* supported by non-adjustable flights, a plurality of upper intermediate rolls 511*a* that are supported by and nested with the upper back up bearings 500*a*, and a plurality of upper work rolls 501*a* that are nested with the upper intermediate rolls 511*a* and supported by the upper backup bearings 500*a*. The adjustable backup 508 also includes a row of lower backup bearings 500*b* supported by adjustable flights, a plurality of lower intermediate rolls 511*b* that are supported by and nested with the lower backup bearings 500*b*, and a plurality of lower work rolls 501*b* nested with the lower intermediate rolls 511*b* and supported by the lower backup bearings 500*b*. The intermediate rolls 511*a* and 511*b* may be used to substantially reduce or eliminate work roll slippage that might otherwise damage the strip material 100 or mark relatively soft or polished surfaces of the strip material 100. Generally, journals (not shown) rotatably couple the lower and upper work rolls 501*a-b* and intermediate rolls 511*a-b* to the frame 502 to allow rotation of the work rolls 501*a-b* and intermediate rolls 511*a-b*.

The upper work rolls 501*a* and the lower work rolls 501*b* are arranged in an offset relationship (e.g., a nested or alternating relationship) relative to one another on opposing sides of the strip material 100 being processed to create a material path that wraps above and below opposing surfaces of alternating upper and lower work rolls 501*a-b*. Engaging opposing surfaces of the material 100 using the upper and the lower work rolls 501*a-b* in such an alternating fashion facilitates releasing the residual stresses in the strip material 100 to condition (e.g., flatten, level, etc.) the strip material 100.

The split drive lever 102 can change the length of the strip material 100 by adjusting the upper and lower work rolls 501*a-b* to create a longer path. Creating a longer path by increasing a plunge of the work rolls 501*a-b* causes the strip material 100 to stretch and elongate further than a shorter path created by decreasing a plunge of the work rolls 501*a-b*.

In the illustrated example, the split drive leveler 102 uses the adjustable backup 508 (i.e., adjustable flights) to increase or decrease the plunge depth between the upper and the lower work rolls 501*a-b*. Specifically, hydraulic cylinders 520 and 521 move the bottom backup 508 via the adjustable flights to increase or decrease the plunge of the upper and the lower work rolls 501*a-b*. In other example implementations, the plunge of the work rolls can be adjusted by moving the upper backup 506 with respect to the bottom backup 508 using, for example, motor and screw (e.g., ball screw, jack screw, etc.) configurations.

A user may provide material thickness and yield strength data via, for example, a controller user interface (e.g., a user interface of the controller 616 of FIG. 6) to cause a controller to automatically adjust the work rolls 501*a-b* to a predetermined entry and exit work roll plunge depth corresponding to the particular strip material data provided by the user. For example, the controller 616 may control hydraulic cylinders 520 and 521 to adjust the backup 508 to bring the back-up bearings 500*b* into pressure contact with the work rolls 501*b* to control deflection and/or tilt position of the work rolls 501*a-b* to determine the location and manner in which the strip material 100 is conditioned. In this manner, less pressure may be applied to the ends of the work rolls 501*b* so that the centers of the work rolls 501*b* apply more pressure to the strip material 100 than that applied to the edges. By adjusting the lower backup bearings 500*b* differently across the width of the lower work rolls 501*b*, different plunge forces can be applied across the width of the strip material 100 to correct different defects (e.g., the defects described above in connection with FIGS. 2A-2E) in the strip material 100.

Figure 10:
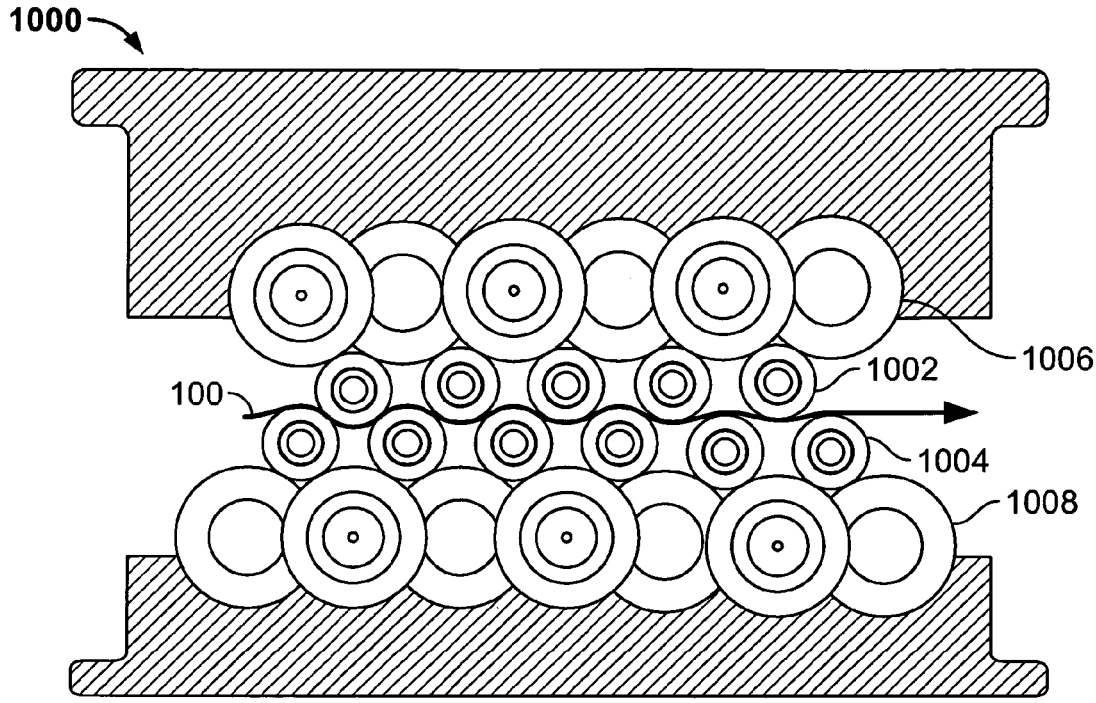
FIG. 10 illustrates another example dual or split drive leveler.
Figure 11:
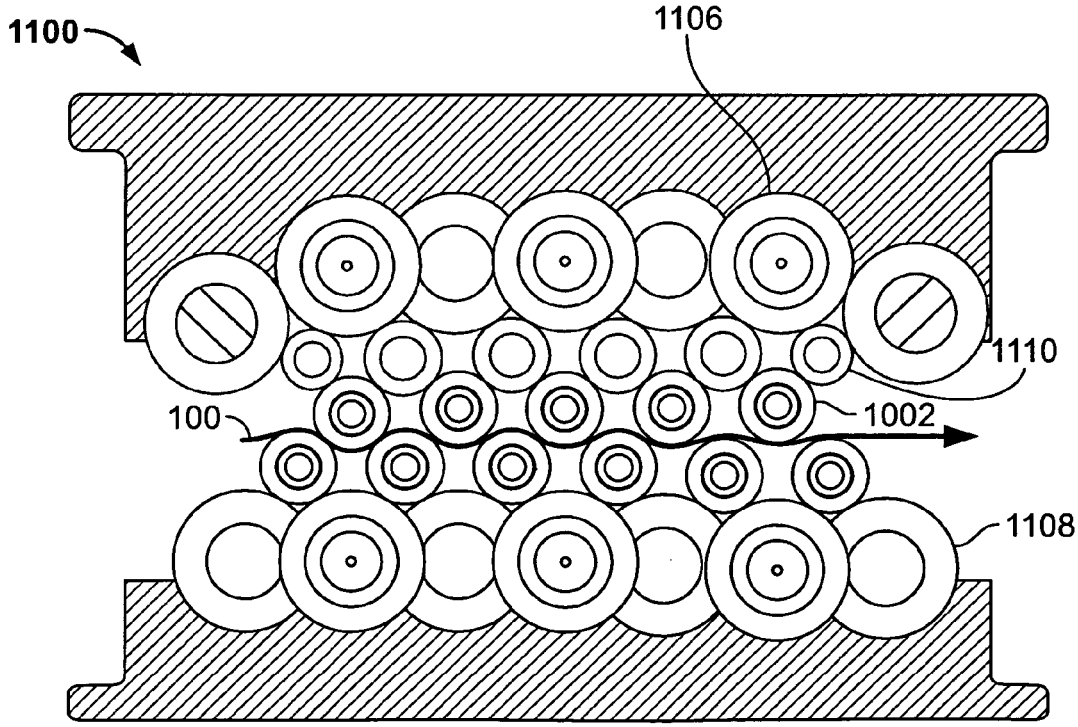
FIG. 11 illustrates yet another example dual or split drive leveler.

The roll configuration of the example split drive lever 102 as shown in FIG. 5 is a six-high leveler configuration. However, in other example configurations, other example methods and apparatus described herein may be implemented in connection with different roll configurations. FIGS. 10 and 11 illustrate other example leveler configurations that can be used in connection with the example methods and apparatus described herein. The example leveler 1000 of FIG. 10 is configured to include upper and lower work rolls 1002 and 1004 and upper and lower backup bearings 1006 and 1008 arranged in a four-high leveler configuration. The example split drive leveler 1100 of FIG. 11 is configured to include upper and lower work rolls 1102 and 1104, upper and lower backup bearings 1006 and 1008, and a row of intermediate rolls 1110 arranged in a five-high leveler configuration.

Figure 6:
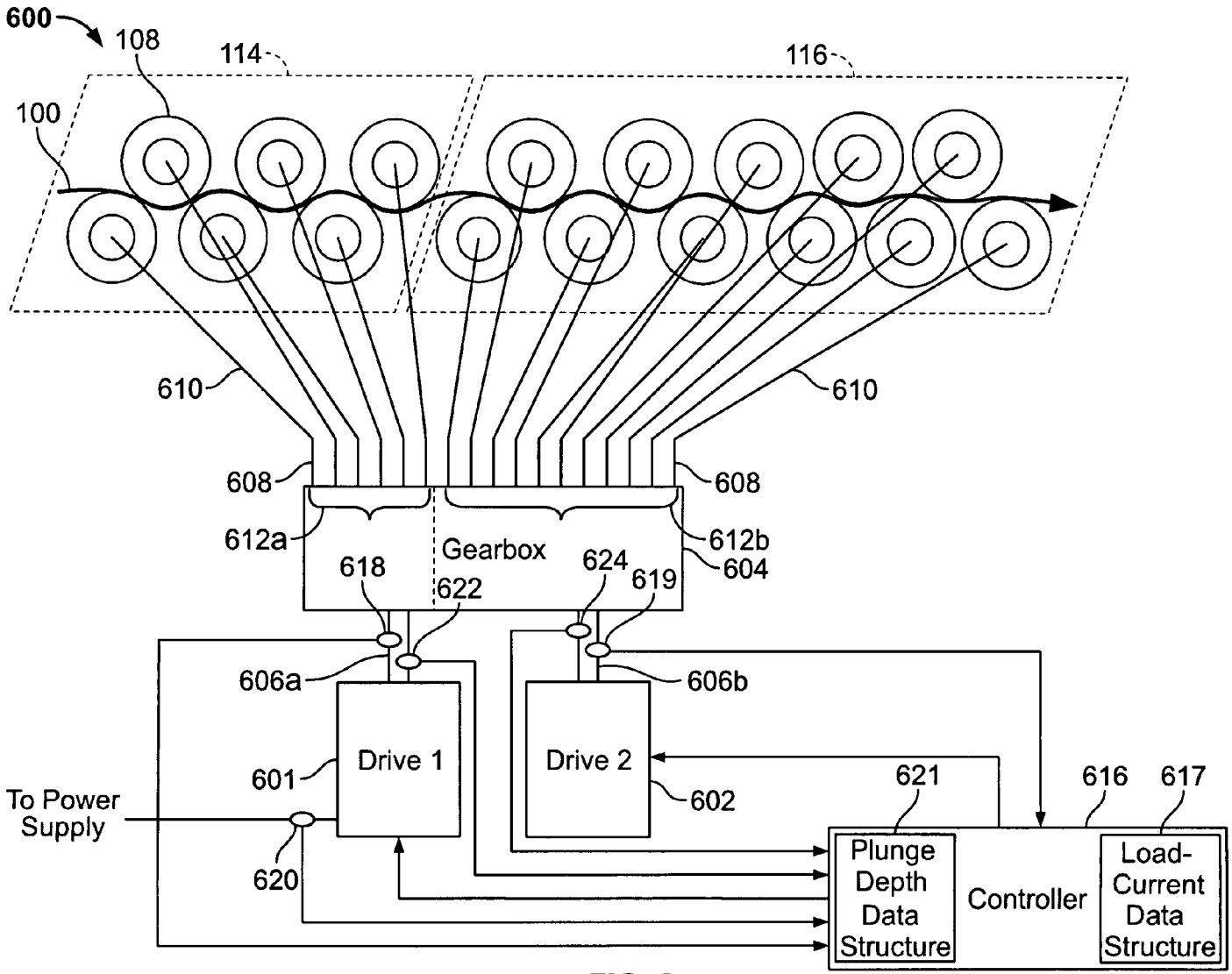
FIG. 6 illustrates an example system that may be used to drive the dual or split drive leveler of FIGS. 1A, 1B, and 5.

FIG. 6 illustrates an example drive system 600 to drive the split drive leveler 102 of FIGS. 1A, 1B, and 5. In the illustrated example, the split drive leveler 102 (FIGS. 1A, 1B, and 5) includes a first motor 601 and a second motor 602, which are also shown in the plan view of FIG. 1B. The first motor 601 drives the entry work rolls 114 and the second motor 602 drives the exit work rolls 116. The first and second motors 601 and 602 may be implemented using any suitable type of motor such as, for example, an AC motor, a DC motor, a variable frequency motor, a stepper motor, a servo motor, a hydraulic motor, etc.

As shown by way of example in FIG. 6, the entry work rolls 114 can be implemented using six of the work rolls 108 and the exit work rolls 116 can be implemented using eleven of the work rolls 108. In other example implementations, the number of the work rolls 108 arranged in the entry work rolls 114 and the exit work rolls 116 can be different than shown in the illustrated example.

In the illustrated example, to transfer rotational torque from the motors 601 and 602 to the work rolls 108, the example drive system 600 is provided with a gearbox 604. The gearbox 604 includes two input shafts 606*a* and 606*b*, each of which is operatively coupled to a respective one of the motors 601 and 602. The input shafts 606*a-b* are also shown in FIG. 1B. The gearbox 604 also includes a plurality of output shafts 608, each of which is used to operatively couple a respective one of the work rolls 108 to the gearbox 604 via a respective coupling 610 (e.g., a drive shaft, a gear transmission system, etc.). An example configuration that may be used to connect the output shafts 608 to the work rolls 108 is shown in FIG. 1B. In other example implementations, the couplings 610 can alternatively be used to operatively couple the output shafts 608 of the gearbox 604 to the upper and lower backup rolls 500*a* and 500*b* (FIG. 5) and/or the upper and lower intermediate work rolls 511*a* and 511*b* (FIG. 5) which, in turn, drive the work rolls 108.

The output shafts 608 of the gearbox 604 include a first set of output shafts 612*a* and a second set of output shafts 612*b*. The first motor 601 drives the first set of output shafts 612*a* and the second motor 602 drives the second set of output shafts 612*b*. Specifically, the input shafts 606*a* and 606*b* transfer the output rotational torques and rotational speeds from the motors 601 and 602 to the gearbox 604, and each of the output shafts 612*a* and 612*b* of the gearbox 604 transmits the output torques and speeds to the work rolls 108 via respective ones of the couplings 610. In this manner, the output torques and speeds of the motors 601 and 602 can be used to drive the work rolls 108 at different rolling torques and speeds.

In other example implementations, two gearboxes may be used to drive the entry and exit work rolls 114 and 116. In such example implementations, each gear box has a single input shaft and a single output shaft. Each input shaft is driven by a respective one of the motors 601 and 602, and each output shaft drives its respective set of the work rolls 108 via, for example, a chain drive system, a gear drive system, etc.

In the illustrated example of FIG. 6, the split drive leveler 102 (FIGS. 1A, 1B, and 5) is provided with torque sensors 618 and 619 (also shown in FIG. 1B) to monitor the output torques of the first motor 601 and the second motor 602, respectively. The torque sensor 618 can be positioned on or coupled to the shaft 606*a* of the first motor 601, and the torque sensor 619 can be positioned on or coupled to the shaft 606*b* of the second motor 602. The torque sensors 618 and 619 may be implemented using, for example, rotary strain gauges, torque transducers, encoders, rotary torque sensors, torque meters, etc. In other example implementations, other sensor devices may be used instead of torque sensors to monitor the torques of the first and second motors 601 and 602. In some example implementations, the torque sensors 618 and 619 can alternatively be positioned on shafts or spindles of the work rolls 108 to monitor the rolling torques of the entry work rolls 114 and the exit work rolls 116.

In yet other example implementations, the split drive leveler 102 can be provided with encoders 622 and 624 to monitor the output speeds of the first motor 601 and the second motor 602. The encoders 622 and 624 can be engaged to and/or coupled to the shafts 606*a* and 606*b*, respectively. The encoders 622 and 624 may be implemented using, for example, an optical encoder, a magnetic encoder, etc. In yet other example implementations, other sensor devices may be used instead of an encoder to monitor the speeds of the motors 601 and 602 and/or the entry and exit work rolls 114 and 116.

In the illustrated example, the example drive system 600 is provided with a controller 616 to control the output torque of the first and second motors 601 and 602 and, thus, control the rolling torques of the entry work rolls 114 and exit work rolls 116. As discussed in greater detail below, the controller 616 monitors the output torque of the first motor 601 and controls the second motor 602 to produce relatively more output torque than the first motor 601. For example, the second motor 602 can be controlled to produce a second output torque to first output torque ratio value that is greater than one and/or to provide a torque output at the second motor 602 that is a particular percentage (e.g., a predetermined percentage) greater than the first motor 601. Additionally or alternatively, the controller 616 can control the output speeds of the first and second motors 601 and 602 to control the speeds of the entry work rolls 114 and exit work rolls 116. For example, the controller 616 can control the speed of the second motor 602 so that it operates at a faster speed than the first motor 601 (e.g., a second speed to first speed ratio value that is greater than one or some other predetermined value).

The example methods and apparatus described herein are used to increase the rolling torque and/or speed of the exit work rolls 116 to be relatively greater than the rolling torque and/or speed of the entry work rolls 114 to generate significantly better leveling, flattening, conditioning, etc. results than do traditional levelers that maintain the rolling torque and/or speed of entry work rolls the same as the rolling torque and/or speed of the exit rolls during a material conditioning process. In particular, matching the rolling torque and/or speed of entry work rolls to the rolling torque and/or speed of exit work rolls limits the amount by which the strip material 100 can be elongated and/or stretched. Thus, the work rolls can only be effective in reducing residual stresses near the surfaces of the strip material 100 because the material is symmetrically stretched such that the neutral axis 308 (FIG. 3B), or neutral area along the longitudinal center of the strip material 100, is neither elongated nor compressed beyond its yield point (i.e., the strip material 100 is not stretched beyond an elastic phase represented by the elastic region 306 of FIG. 3).

Unlike traditional techniques, the example methods and apparatus described herein apply a greater rolling torque and/or speed to the exit work rolls 116 than the entry work rolls 114 so that as the strip material 100 is stretched and elongated by the entry work rolls 114 to increase a length of the strip material 100, the greater torque and/or speed of the exit work rolls 116 drives the exit work rolls 116 to take up or pull the additional material length and maintain (or increase) the tension in the strip material 100 between the entry and exit points of the leveler 102. Unlike traditional tension levelers that use separate tension bridal rolls (e.g., a first set of tension bridal rolls near an entry of a leveler and a second set of tension bridal rolls near an exit of the leveler) to keep a strip material under tension, the example methods and apparatus described herein keep the strip material 100 under tension using the work rolls 108 by driving the entry work rolls 114 and exit work rolls 116 at different torques and/or speeds as described above without requiring separate tension bridal rolls.

By maintaining the tension in this manner, the entry work rolls 114 can effectively apply sufficient plunge force against the strip material 100 to stretch the material beyond the elastic phase into the plastic phase, thereby decreasing or eliminating internal stresses of the strip material 100. Controlling the drive system 600 in this manner can achieve relatively more effective conditioning (e.g., leveling) of the strip material 100 than traditional systems by generating relatively more rolling torque (e.g., a second rolling torque to first rolling torque ratio value greater than one) and/or faster speed (e.g., a second speed to first speed ratio value greater than one) at the exit work rolls 116 than at the entry work rolls 114. That is, operating the drive system 600 in this manner increases the effectiveness of the split drive leveler 102 by causing substantially the entire thickness of the strip material 100 to be bent to the plastic region (FIG. 3B), thereby releasing substantially all of the internal residual stresses or at least relatively more internal residual stresses than achieved using traditional methods.

The amount of plunge force required to deform the strip material 100 to its plastic phase (e.g., the plastic region 310 of FIG. 3B) depends on the plasticity ratio and the yield strength of the strip material 100. The rotational torque required to rotate the work rolls 108 is directly proportional to the plunge force of the work rolls 108 because increasing the plunge force increases the friction on the work rolls 108 working against the rotational motion of the work rolls 108. Thus, increasing the plunge force, in turn, increases a load on a motor. To overcome the load resulting from the plunge force, the motor must produce sufficient mechanical power (e.g., horsepower) to provide an output torque that is greater than the load to rotate the plunged work roll. Thus, because the mechanical power is directly proportional to the output torque (and speed) of the motor, the amount of mechanical power required by the motor to process or condition a particular portion or zone of the strip material 100 is dependent on and directly proportional to the amount of plunge required to deform that material zone or portion. The greater the plunge of the work rolls 108, the greater the amount of mechanical power a motor must produce to deform the strip material 100 to its plastic phase.

The mechanical power generated by a motor is directly proportional to the electrical power consumption of the motor, which can be determined based on the constant voltage applied to the motor and the variable current drawn by the motor in accordance with its mechanical power needs. Accordingly, the output torque of a motor can be controlled by controlling an input electrical current of the motor. Under the same principle, the output torque of a motor can be determined by measuring the electrical current drawn by the motor. Thus, the amount of plunge distance required to apply a necessary plunge force to the strip material 100 can be determined by monitoring the current of a motor (e.g., the motor 601). If the measured current drawn by the motor indicates that a plunge force applied by the work rolls 108 is lower than the plunge force required to condition a material being processed, the plunge depth of the work rolls 108 can be increased until the measured current draw of the motor is indicative of the required amount of plunge force applied by the work rolls 108.

A mechanical load-current correlation data structure or look-up table 617 may be stored in the controller 616 to store mechanical power values in association with electrical current values. The electrical current values can include predetermined current ranges corresponding to different mechanical power outputs generated by a motor. For example, the database or data structure 617 can store the amount of mechanical power required to operate a motor that is subject to a particular load generated by a plunge force required to condition the strip material 100. The mechanical power values can be stored in association with electrical current values required to drive the first motor 601 to produce enough mechanical power (e.g., horsepower) and, thus, output torque to condition the strip material 100.

Additionally or alternatively, the controller 616 may include a plunge force data structure correlation or look-up table 621 to determine the plunge force required to condition a particular strip material 100. The controller 616 can use the information stored in the plunge force data structure 621 as a reference to determine the amount of plunge force required to condition the strip material 100 by comparing the actual electrical current draw of the motor 601 with a reference electrical current stored in the data structure 617. The plunge depth of the entry work rolls 114 can be increased or decreased until the current drawn by the first motor 601 correlates with the plunge force required to condition the particular strip material 100.

As discussed above, the entry work rolls 114 are set at a greater plunge than the exit work rolls 116 and, thus, require that the first motor 601 typically draw relatively more electrical current than the second motor 602. A current sensor 620 between a power source (not shown) and the first motor 601 measures the current of the first motor 601. In this manner, the plunge required for the entry work rolls 114 can be adjusted based on the measured electrical current drawn by the first motor 601 until the output torque of the first motor 601 is substantially similar or equal to a predetermined output torque required to condition a strip material 100 at a plunge depth. In some example implementations, the measured electrical current drawn by the first drive motor 601 can be advantageously used to improve the energy efficiency and life of the motor 601 by preventing the first motor 601 from overworking and causing internal damage to the motor and/or causing damage to the drive shafts and gear transmission system.

Figure 7:
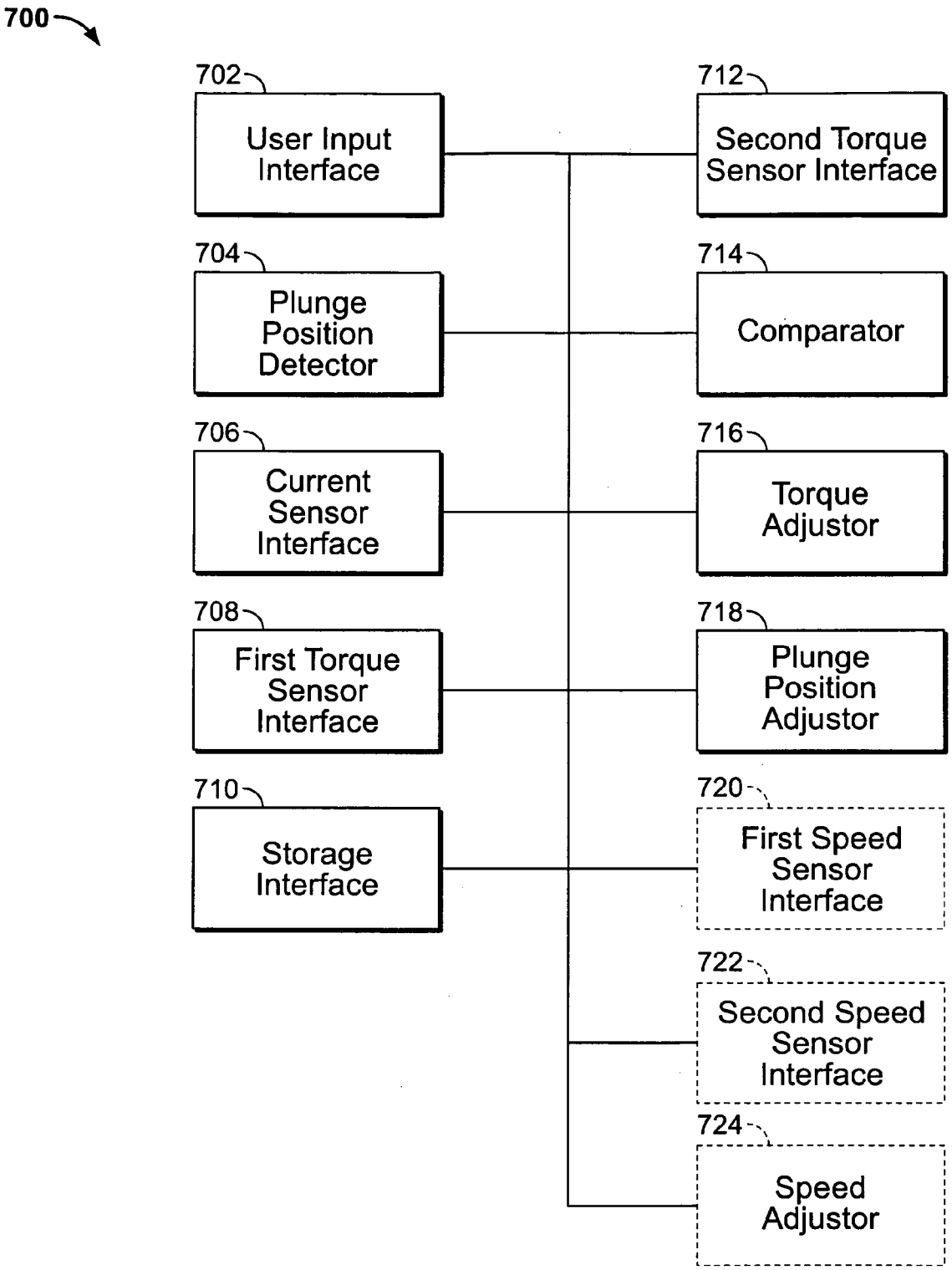
FIG. 7 is a block diagram of an example apparatus that may be used to implement the example methods described herein.

FIG. 7 is a block diagram of an example apparatus 700 that may be used to implement the example methods described herein. In particular, the example apparatus 700 may be used in connection with and/or may be used to implement the example system 600 of FIG. 6 or portions thereof to adjust the output torque of the second motor 602 so that it can generate relatively more torque than the first motor 601 (e.g., a second output torque to first output torque ratio value that is greater than one and/or a predetermined value). The example apparatus 700 may also be used to implement a feedback process to adjust the plunge depth of the work rolls 114 and 116 (FIG. 6) to condition the strip material 100. Additionally or alternatively, the example apparatus 700 may be used to adjust the output speed of the second motor 602 so that it can operate at a relatively faster speed than the first motor 601 (i.e., a second speed to first speed ratio value that is greater than one and/or a predetermined value).

The example apparatus 700 may be implemented using any desired combination of hardware, firmware, and/or software. For example, one or more integrated circuits, discrete semiconductor components, and/or passive electronic components may be used. Additionally or alternatively, some or all of the blocks of the example apparatus 700, or parts thereof, may be implemented using instructions, code, and/or other software and/or firmware, etc. stored on a machine accessible medium that, when executed by, for example, a processor system (e.g., the processor system 910 of FIG. 9) perform the operations represented in the flowchart of FIGS. 8A and 8B. Although the example apparatus 700 is described as having one of each block described below, the example apparatus 700 may be provided with two or more of any block described below. In addition, some blocks may be disabled, omitted, or combined with other blocks.

As shown in FIG. 7, the example apparatus 700 includes a user input interface 702, a plunge position detector 704, a current sensor interface 706, a first torque sensor interface 708, a storage interface 710, a second torque sensor interface 712, a comparator 714, a torque adjustor 716, and a plunge position adjustor 718, all of which may be communicatively coupled as shown or in any other suitable manner.

The user input interface 702 may be configured to determine strip material characteristics such as, for example, a thickness of the strip material 100, the type of material (e.g., aluminum, steel, etc.), etc. For example, the user input interface 702 may be implemented using a mechanical and/or graphical user interface via which an operator can input the strip material characteristics.

The plunge position detector 704 may be configured to measure the plunge depth position values of the work rolls 108. For example, the plunge position detector 704 can measure the vertical position of the work rolls 108 to achieve a particular plunge depth (e.g., the distance ($d_2$) 404*b* between the work rolls 108 of FIG. 4B). The plunge position detector 704 can then communicate this value to the comparator 714.

The current sensor interface 706 may be communicatively coupled to a current sensor or current measuring device (e.g., the current sensor 620 of FIG. 6) and configured to obtain the electrical current draw value of, for example, the first motor 601 of FIG. 6. The current sensor interface 706 may periodically read (e.g., retrieve or receive) electrical current measurement values from the current sensor 620. The current sensor interface 706 may then send the current measurement values to the comparator 714. Additionally or alternatively, the current sensor interface 706 may communicate the current value to the plunge position adjustor 718. Based on the plunge depth values stored in the look-up table 621 in association with the characteristics of the strip material received from the user input interface 702, the plunge position adjustor 718 may then use the current measurement value from the current sensor interface 706 to adjust the plunge depth of the work rolls 108.

The first torque sensor interface 708 may be communicatively coupled to a torque sensor or torque measurement device such as, for example, the torque sensor 618 of FIG. 6. The first torque sensor interface 708 can be configured to obtain the torque value of, for example, the first motor 601 and may periodically read (e.g., retrieve or receive) torque measurement values from the torque sensor 618. The first torque sensor interface 708 may be configured to then send the torque measurement value to the comparator 714.

Figure 9:
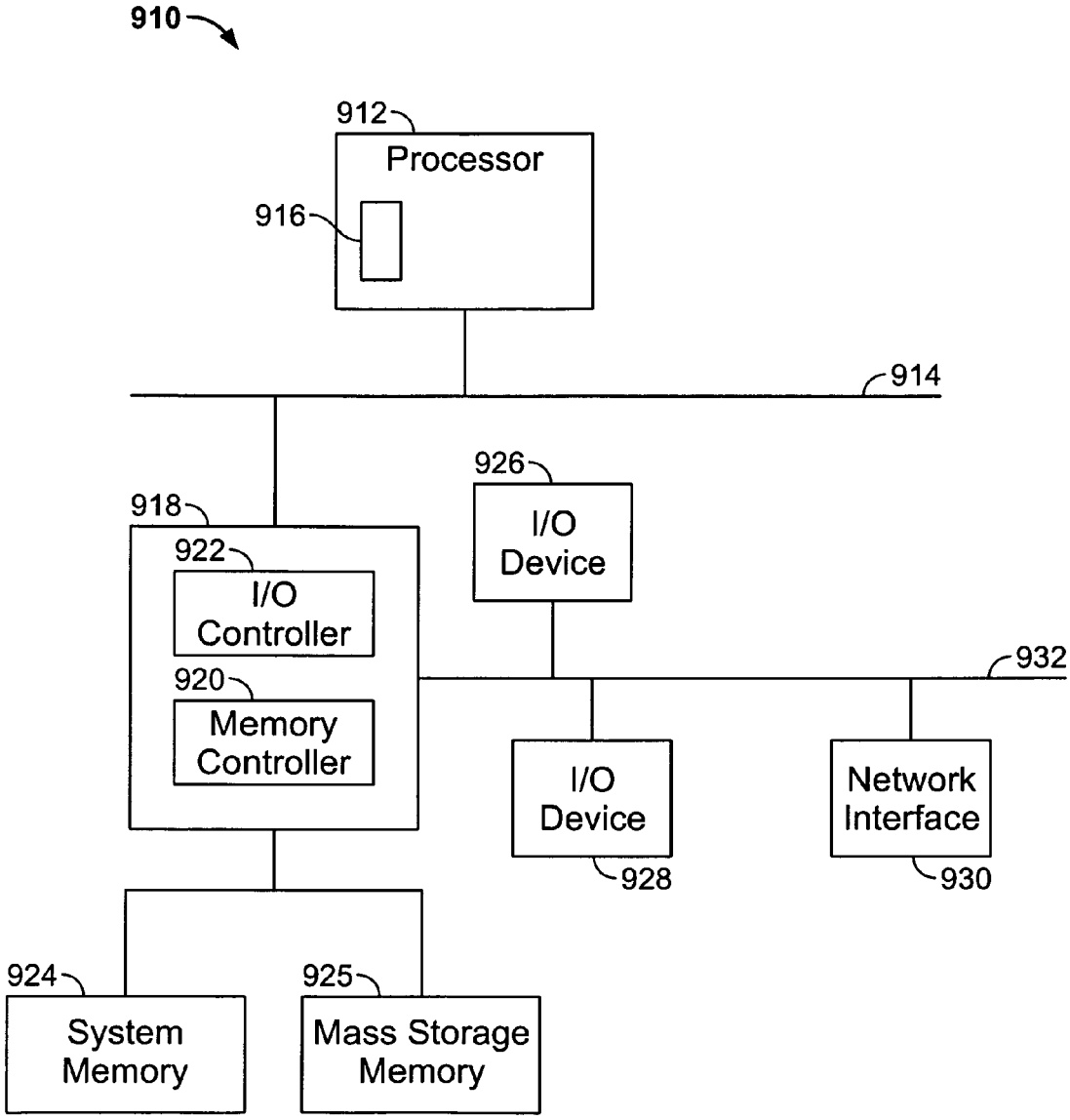
FIG. 9 is a block diagram of an example processor system that may be used to implement the example methods and apparatus described herein.

The storage interface 710 may be configured to store data values in a memory such as, for example, the system memory 924 and/or the mass storage memory 925 of FIG. 9. Additionally, the storage interface 710 may be configured to retrieve data values from the memory (e.g., from the data structure 621 of FIG. 6). For example, the storage interface 710 may access the data structure 621 of FIG. 6 to obtain plunge position values from the memory and communicate the values to the plunge position adjustor 718. Additionally or alternatively, the storage interface 710 may access the data structure 617 of FIG. 6 to retrieve load-current correlation data corresponding to mechanical power outputs generated by a motor required to rotate work rolls when a certain plunge depth is desired for a particular strip material and communicate the load-current values to the comparator 714.

The second torque sensor interface 712 may be communicatively coupled to a torque sensor or torque measurement device such as, for example, the torque sensor 619 of FIG. 6. The second torque sensor interface 712 can be configured to obtain the torque value of, for example, the second motor 602 and may periodically read torque measurement values from the torque sensor 619. The second torque sensor interface 712 may be configured to then send the torque measurement values to the comparator 714.

The comparator 714 may be configured to perform comparisons based on values obtained from the plunge position detector 704, the current sensor interface 706, the first torque sensor interface 708, the storage interface 710, and/or the second torque sensor interface 712. For example, the comparator 714 may be configured to compare electrical current values obtained from the current sensor interface 706 and torque measurement values from the first torque sensor interface 708 with respective predetermined values retrieved by the storage interface 710 from, for example, the load-current correlation data structure 617. The comparator 714 may then communicate the results of the comparisons to the plunge position adjustor 718.

Additionally or alternatively, the comparator 714 may be configured to perform comparisons based on the torque values received from the first torque sensor interface 708 and the second torque sensor interface 712. For example, the comparator 714 may be configured to compare the torque values measured by the first torque sensor interface 708 with the torque values measured by the second torque sensor interface 712 to determine if the second motor 602 is generating relatively more output torque than the first motor 601 (e.g., a second torque output to first torque output ratio value that is greater than one). The comparator 714 may then communicate the results of the comparisons to the torque adjustor 716.

Additionally or alternatively, the comparator 714 may obtain plunge position measurement values from the plunge position detector 704 and compare the plunge position measurement values to predetermined plunge position values that the storage interface 710 retrieves from the data structure 621. The comparator 714 may then communicate the results of the comparisons to the plunge position adjustor 718.

Although the example apparatus 700 is shown as having only one comparator 714, in other example implementations, a plurality of comparators may be used to implement the example apparatus 700. For example, a first comparator can receive the electrical current measurement values from the current sensor interface 706 and the torque measurement values from the first torque sensor interface 708 and compare the values with the predetermined values stored in the load-current correlation data structure 617. A second comparator can receive the torque measurement values from the first torque sensor interface 708 and compare the values to the torque measurement values received from the second torque sensor interface 712.

The torque adjustor 716 may be configured to adjust the torque of the second motor 602 based on the comparison results obtained from the comparator 714. For example, if the comparison results obtained from the comparator 714 indicate that a ratio between the torque measurement value measured by the second torque sensor interface 712 and the torque measurement value measured by the first torque sensor interface 708 is less than or greater than a predetermined torque ratio value (e.g., a ratio value of the second torque value to the first torque value that is greater than one), the torque adjustor 716 can adjust the torque of the second motor 602 until a ratio between the torque measurement value measured by the second torque sensor interface 712 and the torque measurement value measured by the first torque sensor interface 708 is substantially equal to the predetermined torque ratio value (a ratio value of the second output torque to the first output torque that is greater than one).

The plunge position adjustor 718 may be configured to adjust the plunge position of the work rolls 108. The plunge position adjustor 718 may be configured to obtain strip material characteristics from the user input interface 702 to set the vertical positions of the work rolls 108. For example, the plunge position adjustor 718 may retrieve predetermined plunge position values from the storage interface 710 and determine the plunge position of the work rolls 108 based on the strip material input characteristics from the user input interface 702 and corresponding plunge depth values stored in the plunge force data structure 621. Additionally or alternatively, an operator can manually select the plunge depth of the work rolls 108 by entering a plunge depth valve via the user input interface 702.

In addition, the plunge position adjustor 718 may adjust plunge position based on the comparison results obtained from the comparator 714. For example, if a comparison result obtained from the comparator 714 indicates that an electrical current measurement value measured by the current sensor interface 706 does not correlate with a respective current valve from the load-current correlation data structure 617 to create a predetermined plunge force for a particular material, then the plunge position adjustor 718 may adjust the upper and lower work rolls 501*a-b* to increase or decrease the amount of plunge between the upper and lower work rolls 501*a-b* (FIG. 5). The plunge position adjustor 718 may continue to adjust the plunge depth of the work rolls 501*a-b* based on the plunge position measurement values from the plunge position detector 704, the electrical current measurement values from the current sensor interface 706, and the load-current predetermined values retrieved from the load-current correlation data structure 617.

In some example implementations, the example apparatus 700 may be provided with an optional first speed sensor interface 720 that may be communicatively coupled to an encoder or speed measurement device such as, for example, the encoder 622 of FIG. 6. The first speed sensor interface 720 can be configured to obtain speed values of the first motor 601 by, for example, reading measurement values from the encoder 622. The first speed sensor interface 720 may be configured to send the speed values to the comparator 714. The example apparatus 700 may also be provided with an optional second speed sensor interface 722 which may be communicatively coupled to an encoder or speed measurement device such as, for example, the encoder 624 of FIG. 6. The second speed sensor interface 722 can be configured to obtain speed values of the second motor 602 by, for example, reading the speed measurement values from the encoder 624. The second speed sensor interface 722 may be configured to send the speed values to the comparator 714. The comparator 714 may be configured to compare the speed values obtained from the first speed sensor interface 720 and the speed values obtained from the second speed sensor 722 and communicate the comparison results of the comparisons to an optional speed adjustor 724.

The optional speed adjustor 724 may be configured to drive the second motor 602 at a relatively faster speed than the first motor 601 (e.g., a predetermined speed value). For example, if the comparison results obtained from the comparator 714 indicate that a ratio between the speed measurement value measured by the second speed sensor interface 722 and the speed measurement value measured by the first speed sensor interface 720 is less than or greater than a predetermined speed ratio value (e.g., a ratio value of the second output speed value to the first output speed value that is greater than one or some other predetermined value), the speed adjustor 724 can be configured to adjust the speed of the second motor 602 based on the comparison results obtained from the comparator 714 until a ratio between the speed measurement value measured by the second speed sensor interface 722 and the speed measurement value measured by the first speed sensor interface 720 is substantially equal to the predetermined speed ratio value.

Figure 8A:
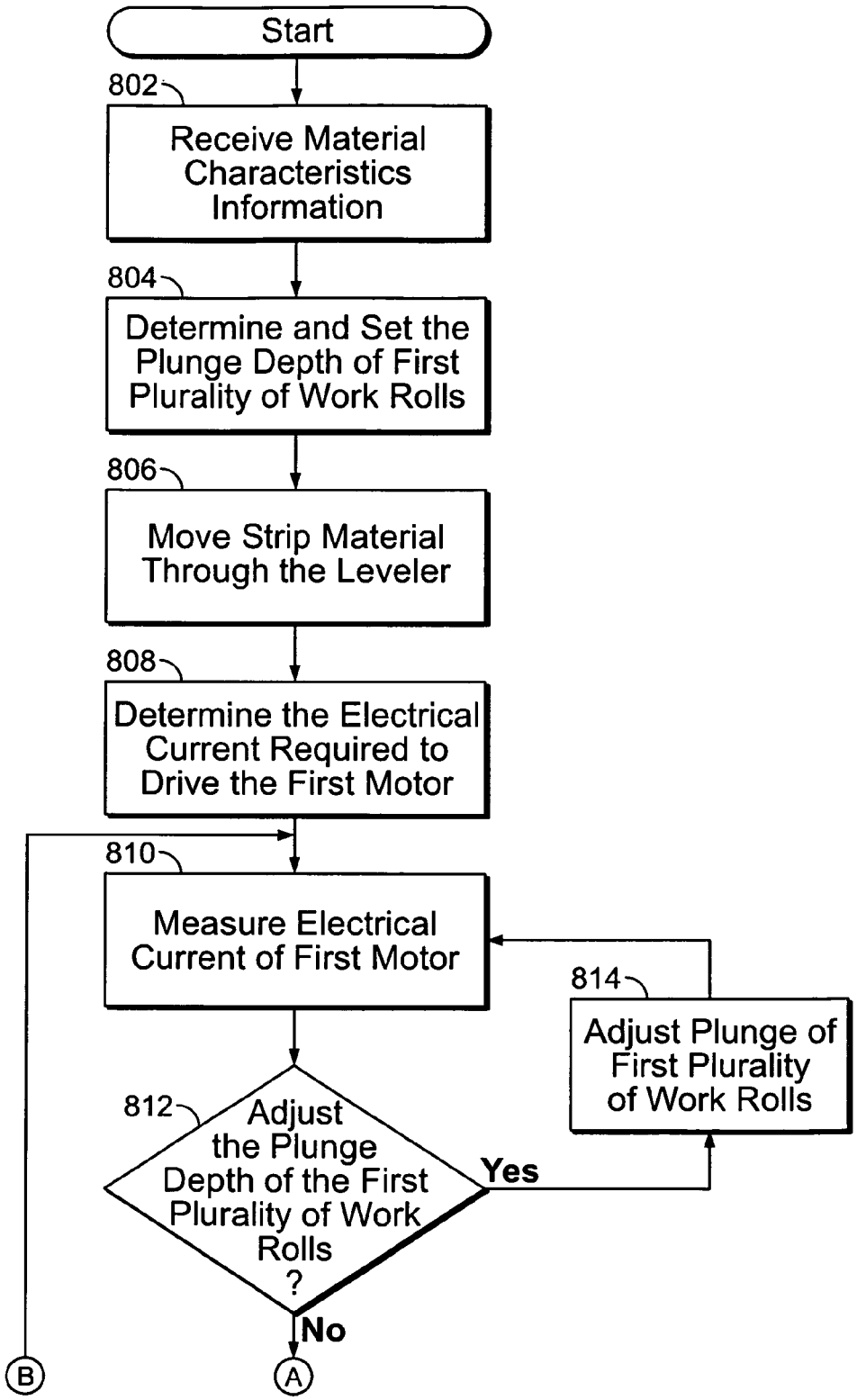
FIGS. 8A and 8B illustrate a flow diagram of an example method that may be implemented to control the example dual or split drive leveler of FIGS. 1A, 1B, and 5.
Figure 8B:
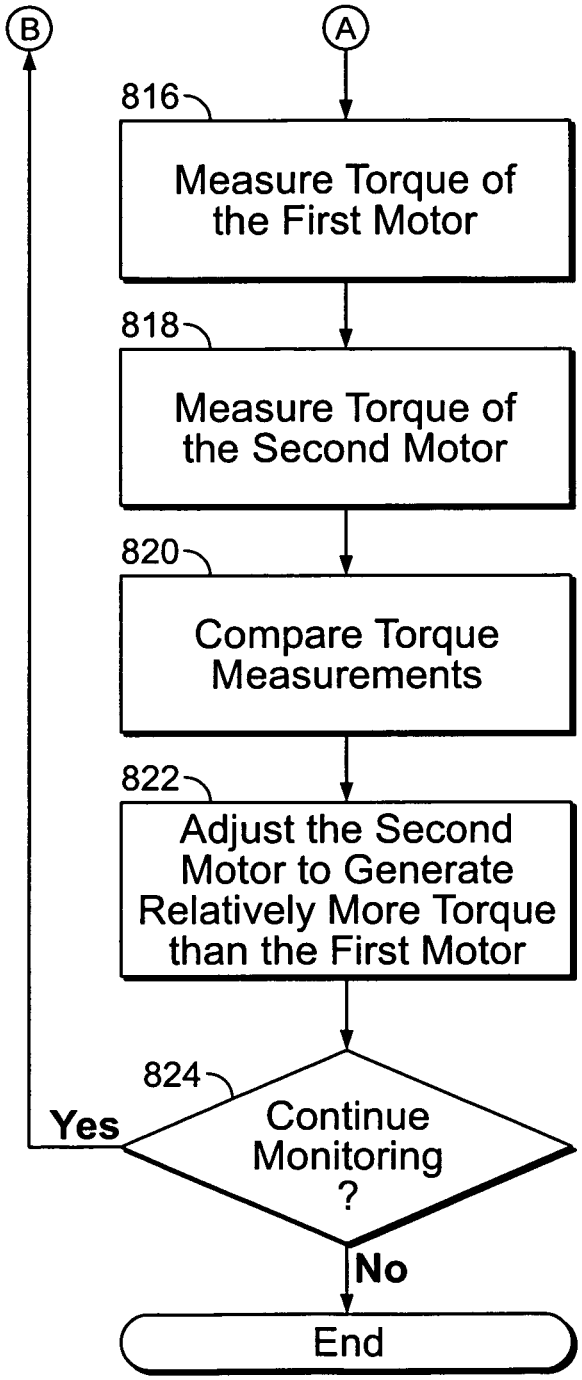

FIGS. 8A and 8B illustrate a flow diagram of an example method that may be used to implement the split drive leveler 102 of FIG. 1A. In some example implementations, the example method of FIGS. 8A and 8B may be implemented using machine readable instructions comprising a program for execution by a processor (e.g., the processor 912 of the example system 910 of FIG. 9). For example, the machine readable instructions may be executed by the controller 616 (FIG. 6) to control the operation of the example drive system 600. The program may be embodied in software stored on a tangible medium such as a CD-ROM, a floppy disk, a hard drive, a digital versatile disk (DVD), or a memory associated with the processor 912 and/or embodied in firmware and/or dedicated hardware. Although the example program is described with reference to the flow diagram illustrated in FIGS. 8A and 8B, persons of ordinary skill in the art will readily appreciate that many other methods of implementing the example split drive lever 102 may alternatively be used. For example, the order of execution of the blocks may be changed, and/or some of the blocks described may be changed, eliminated, or combined.

For purposes of discussion, the example method of FIGS. 8A and 8B is described in connection with the example apparatus 700 of FIG. 7. In this manner, each of the example operations of the example method of FIGS. 8A and 8B is an example manner of implementing a corresponding one or more operations performed by one or more of the blocks of the example apparatus 700 of FIG. 7.

Turning in detail to FIGS. 8A and 8B, initially, the user input interface 702 (FIG. 7) receives material characteristics information (block 802). The material characteristics can include, for example, the thickness of the material, the type of material, etc. The plunge position adjustor 718 determines the plunge depth of the entry work rolls 114 required to process the strip material 100 (block 804) based on the material characteristics received at block 802. For example, the plunge position adjustor 718 can retrieve plunge depth values from a look-up table or data structure (e.g., the data structure 621 of FIG. 6) having start-up plunge depth settings for different material types based on, for example, material yield strengths. In other example implementations, an operator or other user can manually set the initial plunge depth of the entry work rolls 114 and exit work rolls 116.

The strip material 100 may be continuously fed to the leveler 102 (block 806) from an uncoiler (e.g., the uncoiler 103 of FIG. 1A). During the leveling operation, subsequent operations may be performed as the strip material 100 continuously moves through the leveler (e.g., a cutting operation performed by a laser cutter).

Based on load-current information stored in the data structure 617, the example apparatus 700 determines the amount of electrical current required to drive the first motor 601 to produce a required output torque (block 808). For example, the storage interface 710 can retrieve an electrical current value from the data structure 617 of FIG. 6 based on the input data received at block 802.

The current sensor interface 706 (FIG. 7) measures an electrical current drawn by the first motor 601 (block 810) via, for example, the current sensor 620 (FIG. 6). The plunge position adjustor 718 determines whether it should adjust the plunge of the work rolls 114 (block 812). For example, the comparator 714 can compare the measured current value obtained at block 810 to an electrical current value stored in the data structure 617 corresponding to a plunge force required to condition the strip material 100 and communicate the comparison result to the plunge position adjustor 718. If the plunge position adjustor 718 determines that it should adjust the plunge depth of the entry work rolls 114, then the plunge position adjustor 718 adjusts the plunge depth of the first plurality of entry work rolls 114 (block 814) to increase or decrease the plunge force applied to the strip material 100 based on the comparison result information.

After adjusting the plunge depth (block 814), control is returned to block 810 and the current sensor interface 706 again measures the electrical current via the current sensor 620 to monitor the current drawn by the first drive motor 601 (block 810). The operations of blocks 810, 812, and 814 are repeated until the required plunge force is applied by the entry work rolls 114 to the strip material 100. That is, the operations of blocks 810, 812, and 814 are repeated until the measured electrical current drawn by the first motor 601 indicates that the first motor 601 is generating sufficient power (e.g., horsepower) and/or output torque to condition the strip material 100 in a desired manner.

After the plunge position adjustor 718 determines that further adjustment of the plunge of the work rolls 114 is not needed, the first torque sensor interface 708 measures a torque corresponding to the first motor 601 (block 816) (FIG. 8B) via, for example, the torque sensor 618 (FIG. 6). In addition, the second torque sensor interface 712 measures a torque corresponding to the second motor 602 (block 818) via, for example, the torque sensor 619 (FIG. 6). The comparator 714 compares the torque measurement value of the first motor 601 to the torque measurement value of the second motor 602 (block 820), and the torque adjustor 716 adjusts the second motor 602 to generate relatively more torque (e.g., a second output torque to first output torque ratio value that is greater than one) than the first motor 601 (block 822).

Additionally or alternatively, the first speed sensor interface 720 can measure a speed corresponding to the first motor 601 via, for example, the encoder 622 (FIG. 6) and the second speed sensor interface 722 can measure a speed corresponding to the second motor 602 via, for example, the encoder 624 (FIG. 6). The comparator 714 can compare the speed measurement value of the first motor 601 to the speed measurement value of the second motor 602, and the speed adjustor 724 can adjust the second motor 602 to operate at a relatively faster speed than the first motor 601 (e.g., a second output speed to first output speed ratio value that is greater than one).

The example apparatus 700 then determines whether it should continue to monitor the material conditioning process (block 824). For example, if the strip material 100 has exited the leveler 102 and no other strip material has been fed into the leveler 102, then the example apparatus 700 may determine that it should no longer continue monitoring and the example process is ended. Otherwise, control returns to block 810 and the example apparatus 700 continues to monitor and/or adjust the work roll plunge depth to ensure that the appropriate plunge force is applied to each strip material portion fed into the leveler 102. In addition, the example apparatus 700 continues to monitor the torque of the motors 601 and 602 and cause the second motor 602 to maintain a relatively higher output torque than the first motor 601 (e.g., a second output torque to first output torque ratio value greater than one).

As discussed above, the plunge depth of the entry work rolls 114 is set to be relatively more than the exit work rolls 116 and, thus, the amount of plunge force required for the entry work rolls 114 to condition the strip material 100 is relatively more than that required for the exit work rolls 116. In addition, driving the exit work rolls 116 using relatively more rolling torque and/or a relatively faster speed than the entry work rolls 114 causes the exit work rolls 116 to pull the strip material 100 through the split drive leveler 102 during the plunge process of the entry work rolls 114. In this manner, pulling the strip material 100 while it is stretched or elongated by the entry work rolls 114 facilitates further bending of the neutral axis 308 (FIG. 3B) of the strip material 100 toward the wrap angle of the work rolls 108 to cause substantially the entire thickness of the strip material 100 to exceed its yield point and enter a plastic phase resulting in greater deformation of the strip material 100. In this manner, the example methods and apparatus described herein can be used to produce a relatively flatter or more level strip material 100 by releasing substantially all of the residual stresses trapped in the strip material 100, or at least release relatively more residual stresses than do traditional techniques.

FIG. 9 is a block diagram of an example processor system 910 that may be used to implement the example methods and apparatus described herein. As shown in FIG. 9, the processor system 910 includes a processor 912 that is coupled to an interconnection bus 914. The processor 912 includes a register set or register space 916, which is depicted in FIG. 9 as being entirely on-chip, but which could alternatively be located entirely or partially off-chip and directly coupled to the processor 912 via dedicated electrical connections and/or via the interconnection bus 914. The processor 912 may be any suitable processor, processing unit or microprocessor. Although not shown in FIG. 9, the system 910 may be a multi-processor system and, thus, may include one or more additional processors that are identical or similar to the processor 912 and that are communicatively coupled to the interconnection bus 914.

The processor 912 of FIG. 9 is coupled to a chipset 918, which includes a memory controller 920 and an input/output (I/O) controller 922. As is well known, a chipset typically provides I/O and memory management functions as well as a plurality of general purpose and/or special purpose registers, timers, etc. that are accessible or used by one or more processors coupled to the chipset 918. The memory controller 920 performs functions that enable the processor 912 (or processors if there are multiple processors) to access a system memory 924 and a mass storage memory 925.

The system memory 924 may include any desired type of volatile and/or non-volatile memory such as, for example, static random access memory (SRAM), dynamic random access memory (DRAM), flash memory, read-only memory (ROM), etc. The mass storage memory 925 may include any desired type of mass storage device including hard disk drives, optical drives, tape storage devices, etc.

The I/O controller 922 performs functions that enable the processor 912 to communicate with peripheral input/output (I/O) devices 926 and 928 and a network interface 930 via an I/O bus 932. The I/O devices 926 and 928 may be any desired type of I/O device such as, for example, a keyboard, a video display or monitor, a mouse, etc. The network interface 930 may be, for example, an Ethernet device, an asynchronous transfer mode (ATM) device, an 802.11 device, a DSL modem, a cable modem, a cellular modem, etc. that enables the processor system 910 to communicate with another processor system.

While the memory controller 920 and the I/O controller 922 are depicted in FIG. 9 as separate functional blocks within the chipset 918, the functions performed by these blocks may be integrated within a single semiconductor circuit or may be implemented using two or more separate integrated circuits.

Although certain methods and apparatus have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed:

1. A leveler apparatus comprising:

a first plurality of work rolls to process a strip material;

a second plurality of work rolls to process the strip material;

a first motor to drive the first plurality of work rolls, the first motor to apply a first rolling torque to the first plurality of work rolls; and a second motor communicatively coupled to the first motor via a controller, the second motor to drive the second plurality of work rolls, the second motor to apply a second rolling torque to the second plurality of work rolls, wherein the controller is configured to monitor the first rolling torque and the second rolling torque and is configured to maintain a relationship between the first rolling torque and the second rolling torque by repeatedly adjusting the second roller torque based on a change of the first rolling torque.

2. A leveler apparatus as defined in claim 1, wherein the second rolling torque is greater than the first rolling torque, and wherein the relationship between the first rolling torque and the second rolling torque comprises the second rolling torque being a predetermined percentage of the first rolling torque.

3. A leveler apparatus as defined in claim 1, wherein the first motor directly provides the first rolling torque to the first plurality of work rolls and the second motor directly provides the second rolling torque to the second plurality of work rolls.

4. A leveler apparatus comprising:

a first work roll of a first plurality of work rolls to process a strip material;

a second work roll of a second plurality of work rolls to process the strip material;

a first drive motor to apply a first rolling torque to at least the first work roll;

a second drive motor to apply a second rolling torque to at least the second work roll; and a controller to communicatively couple the first and second drive motors, wherein the controller is configured to monitor the first rolling torque and the second rolling torque and is configured to maintain a relationship between the first rolling torque and the second rolling torque by adjusting the second roller torque based on a change of the first rolling torque.

5. A leveler apparatus as defined in claim 4, wherein the second rolling torque is greater than the first rolling torque.

6. A leveler apparatus as defined in claim 4, wherein a ratio of the second rolling torque to the first rolling torque is greater than one.

7. A leveler apparatus as defined in claim 4, further comprising a first sensor to measure the first rolling torque of the first drive motor and a second sensor to measure the second rolling torque of the second drive motor.

8. A leveler apparatus as defined in claim 4, further comprising a sensor to measure a current drawn by the first drive motor.

9. A leveler apparatus as defined in claim 4, wherein the controller is to store a data structure, and wherein the data structure is to store an electrical current value and an output torque value associated with a plunge depth to condition the strip material.

10. A leveler apparatus as defined in claim 4, wherein the first drive motor and the second drive motor operate independently of each other.

11. A leveler apparatus as defined in claim 4, wherein the first drive motor indirectly provides the first rolling torque to the first plurality of work rolls and the second drive motor indirectly provides the second rolling torque to the second plurality of work rolls.

12. A leveler apparatus as defined in claim 4, wherein the first rolling torque is determined by a plunge depth of the first plurality of work rolls.

13. A leveler apparatus as defined in claim 4, wherein the first drive motor is to drive the first plurality of work rolls to a first speed and the second drive motor is to drive the second plurality of work rolls to a second speed greater than the first speed and based on a percentage of the first speed.

14. A leveler apparatus as defined in claim 4, wherein the first plurality of work rolls is located at an entry of the leveler apparatus and the second plurality of work rolls is located at an exit of the leveler apparatus.

15. A leveler apparatus as defined in claim 4, further comprising a gear box having a first input shaft, a second input shaft and a plurality of output shafts, wherein the first drive motor is operatively coupled to the first input shaft, the second drive motor is operatively coupled to the second input shaft and the output shafts are operatively coupled to the first and second pluralities of work rolls.

16. A method of leveling a strip material, the method comprising:

uncoiling a strip material;

moving the strip material through a first plurality of work rolls and a second plurality of work rolls of a material conditioning machine;

driving the first plurality of work rolls via a first driving means;

driving the second plurality of work rolls via a second driving means, the second driving means communicatively coupled to the first driving means via controlling means;

controlling the first driving means to apply a first rolling torque to at least a first work roll of the first plurality of work rolls based on a reference input;

measuring the first rolling torque when the first driving means is operating at the reference input;

determining a second rolling torque using only the measured first rolling torque; and controlling, via the controlling means, the second driving means to apply the second rolling torque to at least a second work roll of the second plurality of work rolls, the controlling means to monitor and maintain a relationship between the first rolling torque and the second rolling torque by adjusting the second rolling torque based on a change of the first rolling torque.

17. A method as defined in claim 16, further comprising processing the strip material through a plurality of idle work rolls disposed between the first plurality of work rolls and the second plurality of work rolls.

18. A method as defined in claim 16, further comprising controlling the first driving means to drive the first plurality of work rolls at a first speed and controlling the second driving means to drive the second plurality of work rolls at a second speed, the second speed determined by a ratio based on the first speed.

19. A method as defined in claim 18, wherein the ratio of the second speed to the first speed is greater than one.

20. A method as defined in claim 16, wherein the first plurality of work rolls are entry work rolls and the second plurality of work rolls are exit work rolls.

21. A method as defined in claim 16, further comprising operating the first driving means independently of the second driving means.

22. A method as defined in claim 16, wherein controlling the first driving means based on the reference input comprises setting the first plurality of work rolls at a plunge depth required to plastically deform the strip material.

23. A method as defined in claim 16, wherein the ratio of the second rolling torque to the first rolling torque is greater than one.

24. A method as defined in claim 16, wherein the first driving means comprises a first motor and the second driving means comprises a second motor.

25. A leveler apparatus as defined in claim 4, wherein each work roll of the first plurality of work rolls and each work roll of the second plurality of work rolls is to be driven by a separate independent motor.

26. A method as defined in claim 16, further comprising driving each work roll of the first plurality of work rolls and the second plurality of work rolls via a separate independent motor.

* * * * *

UNITED STATES PATENT AND TRADEMARK OFFICE

CERTIFICATE OF CORRECTION

PATENT NO. : 8,893,537 B2
APPLICATION NO. : 12/260780
DATED : November 25, 2014
INVENTOR(S) : Clarence B. Cox, III It is certified that error appears in the above-identified patent and that said Letters Patent is hereby corrected as shown below:

In the Claims

In Column 17, line 39 (Claim 1): After “second” replace --roller-- with “rolling”

In Column 17, line 64 (Claim 4): After “second” replace --roller-- with “rolling”

Signed and Sealed this
Twelfth Day of May, 2015

Michelle K. Lee

Michelle K. Lee
*Director of the United States Patent and Trademark Office*